US007837404B2

(12) United States Patent
Iwasa et al.

(10) Patent No.: US 7,837,404 B2
(45) Date of Patent: Nov. 23, 2010

(54) APPLICATOR

(75) Inventors: Atsushi Iwasa, Fujioka (JP); Yukinori Sawa, Fujioka (JP); Akira Fukai, Fujioka (JP); Takahiro Osada, Fujioka (JP)

(73) Assignee: Mitsubishi Pencil Co., Ltd., Shinagawa-Ku, Tokyo (JP)

( * ) Notice: Subject to any disclaimer, the term of this patent is extended or adjusted under 35 U.S.C. 154(b) by 1298 days.

(21) Appl. No.: 10/569,481

(22) PCT Filed: Aug. 13, 2004

(86) PCT No.: PCT/JP2004/011695

§ 371 (c)(1),
(2), (4) Date: Feb. 24, 2006

(87) PCT Pub. No.: WO2005/023559

PCT Pub. Date: Mar. 17, 2005

(65) Prior Publication Data

US 2008/0193197 A1 Aug. 14, 2008

(30) Foreign Application Priority Data

Sep. 5, 2003 (JP) ..... 2003-314560
Sep. 5, 2003 (JP) ..... 2003-314561
Sep. 5, 2003 (JP) ..... 2003-314562

(51) Int. Cl.
*B43K 5/00* (2006.01)

(52) U.S. Cl. ..... 401/198; 401/192

(58) Field of Classification Search ..... 401/192, 401/196, 198, 199, 202, 205, 207
See application file for complete search history.

(56) References Cited

U.S. PATENT DOCUMENTS 4,645,367 A 2/1987 Mutschler et al.

(Continued)

FOREIGN PATENT DOCUMENTS

CN 1429153 7/2003

(Continued)

OTHER PUBLICATIONS

International Search Report issued Nov. 22, 2004 in PCT/JP2004/011695, JPO (in English).

(Continued)

*Primary Examiner*—Huyen Le
(74) *Attorney, Agent, or Firm*—Buchanan Ingersoll & Rooney PC

(57) ABSTRACT

An applicator which includes a rear barrel 1; an ink occlusion element 10 accommodated in rear barrel 1; an ink occlusion element receiver 20 opposing the front end part of ink occlusion element 10; a see-through front barrel 30 fitted to the opening of rear barrel 1, a detection tube 40 inserted in front barrel 30 for flowing ink from ink occlusion element 10; a joint core 50 supported by detection tube 40 and flowing out ink from ink occlusion element 10; and a pen core 60 supported by detection tube 40 and disposed on the opposite side of joint core 50 with a detection space 63 from joint core 50. Detection tube 40, joint core 50 and pen core 60 are formed into an integral structure. It is possible to exactly grasp the ink end state in a visual manner, based on the presence/absence of ink in detection space 63 of detection tube 40.

19 Claims, 7 Drawing Sheets

U.S. PATENT DOCUMENTS

| | | | | |
|---|---|---|---|---|
| 5,286,127 | A * | 2/1994 | Scholz | 401/199 |
| 5,551,789 | A * | 9/1996 | Okawa et al. | 401/199 |
| 5,906,446 | A * | 5/1999 | McCulloch et al. | 401/199 |
| 6,276,860 | B1 | 8/2001 | Nakajima et al. | |
| 6,336,762 | B1 * | 1/2002 | Oike | 401/198 |
| 6,769,827 | B2 | 8/2004 | Furukawa et al. | |
| 2005/0232685 | A1 | 10/2005 | Koyama | |

FOREIGN PATENT DOCUMENTS

| | | | |
|---|---|---|---|
| EP | 1095791 | A1 | 5/2001 |
| GB | 2 114 065 | A | 8/1983 |
| JP | 56-128283 | | 9/1981 |
| JP | 57-6581 | | 1/1982 |
| JP | 58-138699 | A | 8/1983 |
| JP | 58-147399 | A | 9/1983 |
| JP | 59-12684 | U | 1/1984 |
| JP | 06-270585 | A | 9/1994 |
| JP | 03/095231 | A1 | 11/2003 |

OTHER PUBLICATIONS

International Preliminary Report on Patentability with attached Written Opinion, issued Jun. 29, 2006 in PCT/JP2004/011695, IB of WIPO, Geneva, Switzerland (in English).

* cited by examiner

APPLICATOR

TECHNICAL FIELD

The present invention relates to an applicator such as a marker etc., of which ink end can be easily detected.

BACKGROUND ART

There is a type of applicator called a marker, which is a writing instrument of a reservior-type in which ink, water-based ink, oil-based ink etc., is supplied from an ink occlusion element in the rear barrel to a pen core.

Markers of the reservior type can be classified into various types: for example one type (refer to patent literature 1) in which the content from the ink occlusion element to the pen core can be visually grasped by the user, and one type in which alcohol-based ink is used.

Patent literature 1: Japanese Patent Application Laid-open No. Hei 6-270585.

DISCLOSURE OF INVENTION

Problems to be Solved by the Invention

In some types of the conventional reservior type markers the part from the ink occlusion element to the pen core can be visually monitored by the user, it is however impossible for this type to exactly indicate the state of ink end (end sign) though it is possible to know the remaining amount of ink to some extent from the degree of the tone of ink occluded in the ink occlusion element. Accordingly, there is a problem that it is impossible to improve long-term use, convenience and the like.

Further, markers using alcohol-based ink is prone to cause dew condensation, hence suffer the problem that dew condensation causes writing failures. In order to solve this problem, there is a possible method in that felt or sponge is built into the cap so as to let the felt or sponge suppress evaporation from the pen core.

This case, however, will cause a new, serious problem in that dew condensation occurs inside the cap leading to faint drawn lines. To deal with this problem, there is a countermeasure that the resin is formed with a thick wall so as to reduce the variation in the temperature inside the cap. However, this cannot make any reduction in cost.

The present invention has been devised in view of the above, it is therefore an object of the present invention to provide an applicator which enables essentially exact indication of the end state of the fluid to improve long-term use, convenience and the like and which can suppress and prevent writing failures with a low cost, by preventing dew condensation.

Means for Solving the Problems

In order to solve the above problems, in the present invention an applicator for supplying a fluid from a fluid occlusion element to an applying part, includes: a hollow rear barrel accommodating the fluid occlusion element; a fluid occlusion element receiver at least opposing the end portion of the fluid occlusion element; a hollow-formed see-through front barrel to be attached to an opening of the rear barrel; an essentially transparent detection tube inserted in the front barrel; a joint core supported by the detection tube and put in contact with the fluid occlusion element; and a pen core, supported by the detection tube, spaced with a clearance from, and opposing, the joint core, and exposed from the front barrel.

Here, the fluid may be an alcohol-based ink.

Also, it is preferred that the rear barrel is formed as a close-bottomed cylinder having an open front end, and part of the inner peripheral surface of the rear barrel is formed with a large-diametric inner peripheral surface and the remaining part of the inner peripheral surface of the rear barrel is formed with a small-diametric inner peripheral surface.

Further, the fluid occlusion element receiver may be formed of a hollow stepped shape, and the fluid occlusion element receiver may be inserted into the opening of the rear barrel so as to fit with the front end part of fluid occlusion element.

Among the front barrel, detection tube, joint core and pen core, at least the detection tube, joint core and pen core can be integrated.

It is also preferred that the front barrel is given in a transparent stepped shape and fitted into the front end part of the fluid occlusion element receiver.

It is also possible that the detection tube is formed in a cylindrical shape and supported by the fluid occlusion element receiver and the front barrel.

It is also possible that a press-fitting portion is formed on one of the inner peripheral surface of the front barrel and the outer peripheral surface of the detection tube and a press-fitted portion is formed on the other, and these press-fitting portion and press-fitted portion are at least put in strong contact with each other.

It is also preferred that the pen core is given in an essentially cylindrical form and the maximum width portion thereof is fitted into the detection tube.

It is also possible that the detection tube is formed with the fluid occlusion element receiver.

It is also possible that a flange is projected radially outwards from the fluid occlusion element's side end of the detection tube, and the flange is adapted to constitute the fluid occlusion element receiver.

It is further possible that the front end part of the front barrel is formed to be a small-diametric tapered portion that gradually becomes narrower, an attachment groove is formed on the exposed surface of the pen core that is exposed from the detection tube so that a fall stopper is provided in the attachment groove, and the pen core is projected from the small-diametric tapered portion of the front barrel while the fall stopper of the pen core is put in contact with inner surface of the small-diametric tapered portion.

It is also possible that a flange is projected radially outwards from the fluid occlusion element's side end of the detection tube, and a cylindrical portion is extended towards the fluid occlusion element from the peripheral edge of the flange so that the flange and the cylindrical portion constitute the fluid occlusion element receiver.

It is further possible that the fluid occlusion element receiver is formed in an essentially cylindrical form, and the fluid occlusion element receiver is inserted into the rear barrel to fit the end of the fluid occlusion element while an anti-dew-condensation hole is formed in the peripheral wall of the fluid occlusion element receiver.

It is also preferred that fine indentations and projections that produce capillary action is formed on the peripheral wall of the fluid occlusion element receiver, and the pattern is formed with indentations, projections and/or essentially V-shaped sections.

It is also possible that an impact absorbing means that at least absorbs impacts acting on the detection tube is provided.

It is also possible that the impact absorbing means is given as an inclined step face formed between the large-diametric inner peripheral surface, and the small-diametric inner surface, of the rear barrel so as to be in contact with the rim of the opening of the fluid occlusion element receiver.

It is further possible that the impact absorbing means is comprised of a step face between the large-diametric inner peripheral surface, and the small-diametric inner surface, of the rear barrel, and a cushioning element disposed between the step face and the rim of the opening of the fluid occlusion element receiver.

It is still more possible that the impact absorbing means is given as the rear barrel having elasticity.

Here, the fluid occlusion element in Claims preferably has such a capillary distribution that its capillary force becomes greater as it goes towards the pen core. The term "essentially transparent" implies both "transparent" and "translucent". The detection tube may be given as a cylinder, oval cylinder, triangular cylinder, rectangular cylinder, polygonal cylinder, star-shaped cylinder, etc. The surface tension of this detection tube is preferably smaller than that of the fluid. The cross-section of the fluid path of the detection tube preferably ranges from $8\times10^{-2}$ to 80 $mm^2$.

The joint core is preferably put in contact with the fluid occlusion element by the length equal to or greater than 5% of the full-length of the fluid occlusion element. The cross-section of this joint core is preferably 1% to 90% of that of the fluid occlusion element. The capillary force of the joint core is preferably greater than that of the fluid occlusion element. The joint core is preferably formed of two, inner and outer layers with the outer layer portion having a greater capillarity than the inner layer portion.

The press-fitting portion and press-fitted portion may be a pair of a projection and recess, shapes creating friction therebetween by strong contact or shapes forming a mating relationship, etc. Examples of the fall-stopper may include endless O-rings, molding parts, metal parts etc. As to the anti-dew-condensation hole, a single or plurality of holes may be formed. Essentially V-shaped sections may include both U-shaped sections and V-shaped sections.

The impact absorbing means is not particularly limited, but may be provided as, for example a step face formed between the front barrel and the outer peripheral surface of the detection tube, a step face formed between the detection tube and the joint core, etc. The applicator can also be used for various writing instruments such as felt-tipped pens, markers, correction pens, cosmetic applicators, etc.

According to the present invention, the fluid in the rear barrel flows from the fluid occlusion element to the pen core by way of the joint core and detection tube, and application of the fluid can be performed by impregnation of the fluid into the pen core. Since no fluid is present in the essentially transparent detection tube when the application life is over as the fluid has been applied and consumed, it is possible to visually detect the fluid end, etc.

Further, since the anti-dew-condensation holes of the fluid occlusion element receiver lead condensation water from the exterior of the ink occlusion element receiver into the interior of the ink occlusion element receiver, it is possible to suppress the formation of dew condensation. Further, since the indentations and projections causes condensation water, by their capillary attraction, to seep from the exterior of the ink occlusion element receiver to the interior of the ink occlusion element receiver and return into the ink occlusion element or pen core, it is possible to suppress fainting of drawn lines due to dew condensation with minimal fear of the ventilation passage of air being blocked.

Effect of the Invention

The present invention is effective in enabling essentially exact indication of the end state of the fluid and improving long-term use, convenience and the like. It is also possible to suppress or prevent writing failures with a low cost, by preventing dew condensation.

DESCRIPTION OF REFERENCE NUMERALS

Figure 1:
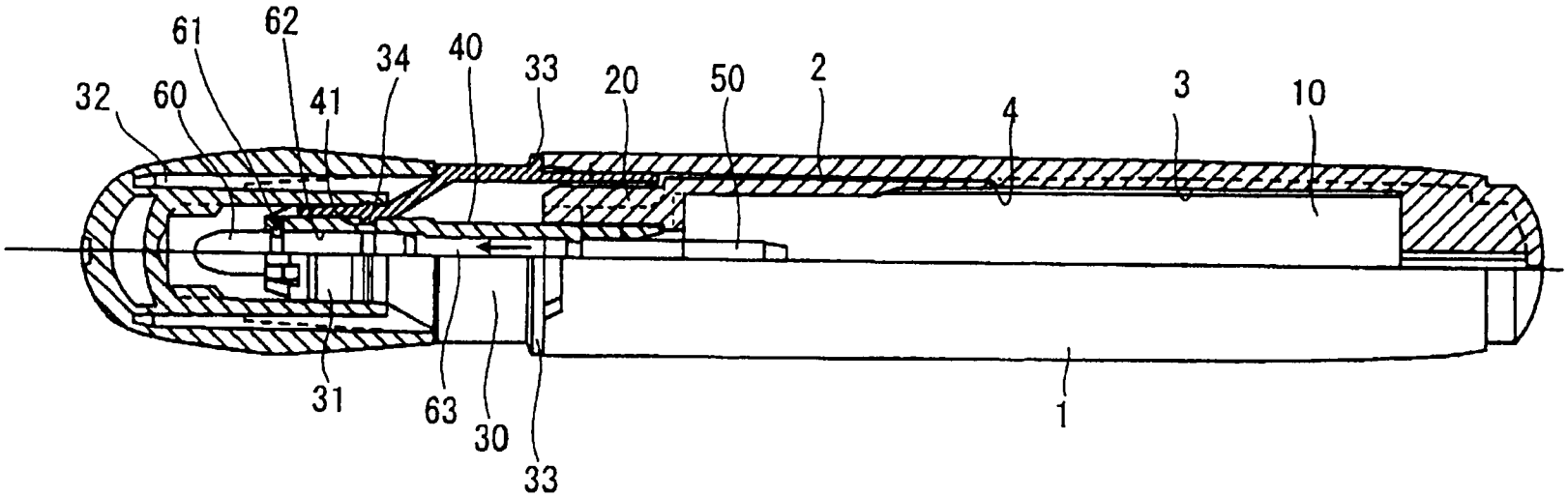
FIG. 1 is a partially sectional illustrative view showing an embodiment of an applicator according to the present invention.

1 rear barrel
2 large-diametric inner peripheral surface
3 small-diametric inner peripheral surface
4 inclined step face
10 ink occlusion element (fluid occlusion element)
20 ink occlusion element receiver (fluid occlusion element receiver)
21 anti-dew-condensation hole
22 indentations and projections

30 front barrel
31 front-end portion
33 positioning flange
34 press-fitting portion
35 small-diametric tapered portion
40 detection tube
41 press-fitted portion
42 flange (fluid occlusion element receiver)
50 joint core
60 pen core
62 maximum width portion
63 detection space (clearance)
64 fall stopper ring (fall stopper)
70 impact absorbing means
71 inclined step face
72 step face
73 cushioning element

BEST MODE FOR CARRYING OUT THE INVENTION

Figure 2:
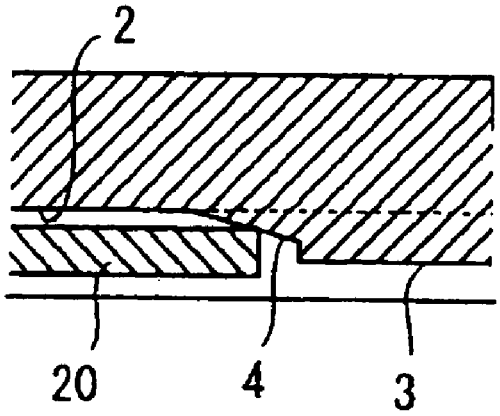
FIG. 2 is a partially sectional illustrative view showing a state where an ink occlusion element receiver is put in contact with an inclined step face of a rear barrel, in an embodiment of an applicator according to the present invention.
Figure 3:
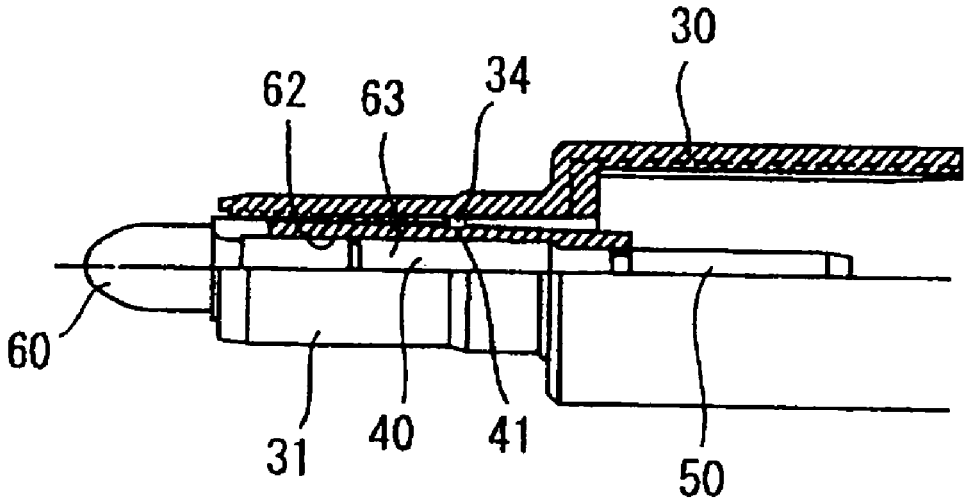
FIG. 3 is a partially sectional illustrative view showing an embodiment of an applicator according to the present invention.

Referring the drawings the preferred embodiment of the present invention will be described hereinbelow. An applicator in the present embodiment includes: as shown in FIGS. 1 to 3, a hollow rear barrel 1; an ink occlusion element 10 replaceably accommodated in this rear barrel 1; an ink occlusion element receiver 20 opposing the front end part of this ink occlusion element 10; an essentially cylindrical, see-through front barrel 30 fitted to the opening of rear barrel 1, a detection tube 40 inserted in this front barrel 30 for flowing the fluid or ink from ink occlusion element 10; a joint core 50 supported by this detection tube 40 and flowing out ink from ink occlusion element 10; and a pen core 60 supported by detection tube 40 and disposed on the opposite side of joint core 50, and is used as a writing instrument of a reservior type marker.

As shown in FIG. 1 rear barrel 1 is given as a close-bottomed cylindrical molding made of a predetermined synthetic resin such as PP or the like, with an open front end and functions as a main body of a writing instrument. This rear barrel 1 is constructed such that its part of the inner peripheral surface, i.e., the approximately front half, is formed with a large-diametric inner peripheral surface 2 and the remaining part of the inner peripheral surface, i.e., the approximately rear half, is formed with a small-diametric inner peripheral surface 3. An inclined step face 4 is formed between these large-diametric inner peripheral surface 2 and small-diametric inner peripheral surface 3 (see FIG. 2). Rear barrel 1 may be formed to be opaque or transparent in view of the appearance or practical use.

Ink occlusion element 10 as a fluid occlusion element is formed in an elongate cylindrical shape using a predetermined material, as shown in FIG. 1 and is impregnated with an ink for writing such as a water-based ink, oil-based ink etc., (see the arrow in FIG. 1). Ink occlusion element 10 as a reservior is formed of a bundle of natural fibers, animal hair fibers, fibers of polyacetal resins, acrylic resins, polyester resins, polyamide resins, polyurethane resins, polyolefin resins, polyvinyl resins, PP resins, polyether resins, polyphenylene resins, felt or etc. Other than these, sponges, resin particles, porous sintered compacts may be selectively used to form it.

In order for the user to monitor the ink end condition correctly, the surface tension of ink is set at 18 mN/m or greater at 25 deg.C. or lower, preferably 20 to 50 mN/m or greater at 25 deg.C. or lower. The surface tension of ink is adjusted by blending a surfactant etc., as necessary to the ink composition.

In order to assure smooth supply of ink to pen core 60 the viscosity coefficient of ink is set at 500 mPa·s or lower, preferably 200 mPa·s or lower, or more preferably 1 to 100 mPa·s or lower at 25 deg.C. or lower. This is specified because if the viscosity coefficient of ink exceeds 500 mPa·s, it is impossible to secure a high enough amount of ink flow hence there is a fear of ink starvation and the like due to the insufficiency of flow amount. The viscosity coefficient of ink is adjusted by blending a thickener etc., as necessary to the ink composition.

Ink occlusion element receiver 20 as a fluid occlusion element receiver is formed of a hollow stepped shape, as shown in the same drawing, using a predetermined synthetic resin such as PP or the like, for example. This ink occlusion element receiver 20 is inserted into the opening at the front end of barrel cylinder 1 with a clearance left therebetween so as to abut against inclined step face 4 and fit in contact with the front side end part of ink occlusion element 10.

As shown in FIG. 1, front barrel 30 is given in a hollow transparent concave form of a synthetic resin consisting of PP or the like with its light transmittance set at 30% to 100%, preferably 50% to 100%, more preferably 80% or greater, and is attached to the opening of rear barrel 1 and fitted into the front end part of the small-diametric portion of ink occlusion element receiver 20.

Front barrel 30 is removably fitted with a cap 32 for protecting the pen core and has an annular positioning flange 33 protruding radially outwards from the outer peripheral surface at approximately the center thereof. This positioning flange 33 comes into positioning contact with the end face of the opening of rear barrel 1. An essentially annular press-fitting portion 34 projected radially inwards is optionally formed in the circumferential direction of the inner peripheral surface of front end part 31.

Detection tube 40 is formed in a see-through cylindrical shape using a predetermined material, as shown in the same drawing, and is supported penetrating through, and between, the front end part of ink occlusion element receiver 20 and front end part 31 of front barrel 30. Examples of the material of this detection tube 40 include polypropylene, polyethylene, cyclo polyolefin, polyolefin resins such as poly(1-methyl-4-pentene) etc., polystyrene, polyethylene terephthalate, polyethylene naphthalate, polybutylene terephthalate, fluororesin, silicone rubber and the like.

The inner peripheral surface of detection tube 40 is optionally subjected to a coating treatment of fluororesin, silicone or the like. This treatment reduces the surface tension of detection tube 40 to lower than the surface tension of ink. A groove-like press-fitted portion 41 is cut out along the circumferential direction on the outer peripheral surface of detection tube 40, so that this press-fitted portion 41 mutually mates with press-fitting portion 34 forming press-fitting engagement.

Joint core 50 is formed in an essentially cylindrical shape using a predetermined material, as shown in the same drawing, and is inserted into, and supported by, detection tube 40 at its ink occlusion element side inside ink occlusion element receiver 20. This joint core 50 is projected from ink occlusion element receiver 20 and inserted into the front end part of ink occlusion element 10 so as to provide a function of supplying ink from ink occlusion element 10 to pen core 60 via detection tube 40.

Joint core 50 is given as bundle of, for example natural fibers, animal hair fibers, fibers of polyacetal resins, acrylic resins, polyester resins, polyamide resins, polyurethane resins, polyolefin resins, polyvinyl resins, polyether resins, polyphenylene resins, felt or etc. Other than these, sponges, resin particles, porous sintered compacts may be used to form it.

Pen core 60 is given in an essentially cylindrical form having a rounded tip as shown in FIG. 1, using a predetermined material, and is fitted into, and supported by detection tube 40 at its end opposite to the ink occlusion element, via an O-ring 61, and is exposed from front end part 31 of front barrel 30. This pen core 60 is formed of a bundle of natural fibers, animal hair fibers, fibers of polyacetal resins, acrylic resins, polyester resins, polyamide resins, polyurethane resins, polyolefin resins, polyvinyl resins, polyether resins, polyphenylene resins, felt or etc. Other than these, sponges, resin particles and porous sintered compacts may be used as appropriate to form it.

Pen core 60 has a hard peripheral surface formed as appropriate with a circumferential groove for an O-ring and its maximum width portion 62 is fitted into detection tube 40. This pen core 60 is arranged opposing the front end part of joint core 50 with a detection space 63 created as a clearance for air replacement therebetween, and is aligned and integrated with detection tube 40 and joint core 50 to thereby supply ink in detection space 63 to the paper surface.

In the above configuration, ink passing from ink occlusion element 10 through joint core 50 and detection tube 40, impregnates pen core 60. This impregnation of pen core 60 with ink enables writing. When ink is reduced and used up by long-term writing, no ink will pass through detection space 63 of transparent detection tube 40 so that it is possible to visually detect the end of ink, simply and clearly.

In the above configuration, it is possible to exactly grasp the end of ink in a visual manner, based on the presence/absence of ink in detection space 63 of detection tube 40, without depending on the degree of color. Accordingly, even if pen core 60 dried out causing ink starvation, no ink end will be detected by mistake, hence this configuration makes it possible to improve long-term use and convenience of the writing instrument.

Further, since detection tube 40, joint core 50 and pen core 60, which are separate parts, are integrated by assembling them into a one-body structure, it is possible to implement assembly easily free from air bubbles entering detection tube 40, hence markedly improve assembly performance and manufacturing performance, etc. Since press-fitting portion 34 and press-fitted portion 41 create a strong engagement, it is possible to efficiently prevent front barrel 30 and/or detection tube 40 from falling etc., by frictional force and fitting force.

Moreover, it is possible to enhance the dimensional stability by fitting the maximum width portion 62 of pen core 60 into detection tube 40 and improve the strength by sealing in the area where a high amount of resin component is contained hence the hardness is high. This configuration makes it possible to prevent pen core 60 from falling during drawing, secure stable sealability and expect the prevention against entrance of air bubbles.

Figure 4:
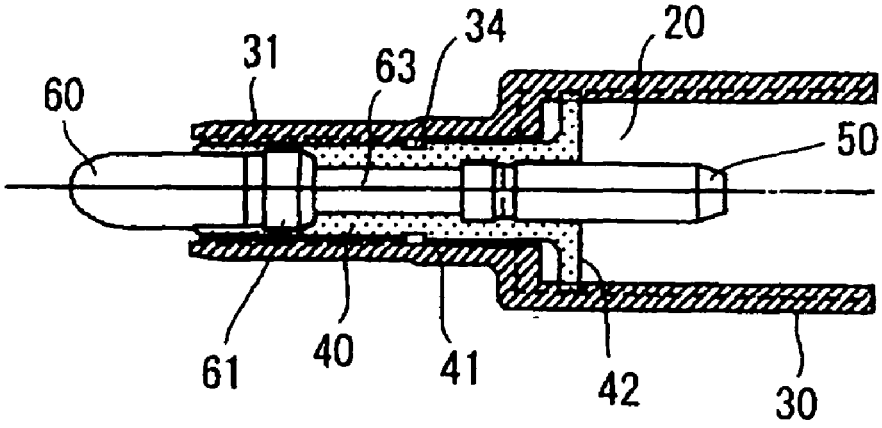
FIG. 4 is a partially sectional illustrative view showing the second embodiment of an applicator according to the present invention.

Next, FIG. 4 shows the second embodiment of the present invention. In this case, detection tube 40 is formed with a flange 42 which is projected radially outwards from the ink occlusion element side end of detection tube 40, so that this flange 42 constitutes ink occlusion element receiver 20 that opposes the front end part of ink occlusion element 10. Other components are the same as in the above embodiment, so their description is omitted.

Also in this embodiment, the same operation and effect as in the above embodiment can be expected. Besides, since flange 42 of detection tube 40 provides the function of ink occlusion element receiver 20, it is possible to omit ink occlusion element receiver 20 as a separate part. Accordingly, it is obvious that assembly performance and manufacturing performance can be markedly improved. Further, since flange 42 of detection tube 40 is put in contact with the inner peripheral surface of front barrel 30 forming a partitioning wall for blocking ink, it is possible to efficiently prevent unnecessary flow of ink from ink occlusion element 10 into a space between front barrel 30 and detection tube 40.

Figure 5:
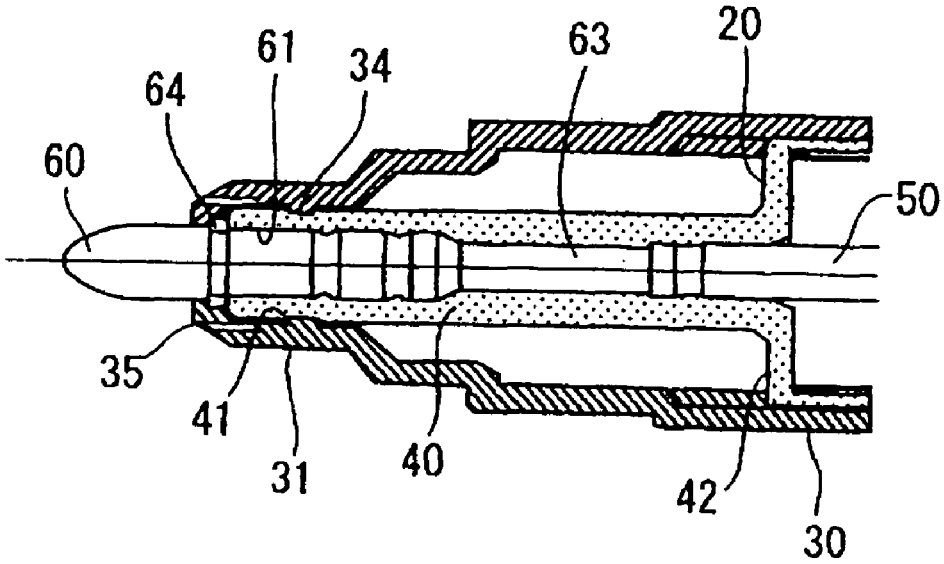
FIG. 5 is a partially sectional illustrative view showing the third embodiment of an applicator according to the present invention.

Next, FIG. 5 shows the third embodiment of the present invention. In this case, front end part 31 of front barrel 30 is formed with a small-diametric tapered portion 35 that gradually becomes narrower. An annular attachment groove is cut out on the pen core 60's exposed surface that is exposed from detection tube 40. An endless fall stopper, namely, fall stopper ring 64 is fitted to this attachment groove so that pen core 60 is projected from small-diametric tapered portion 35 of front barrel 30 while fall stopper ring 64 on pen core 60 is put in abutment with the inner surface of small-diametric tapered portion of front barrel 30.

Front barrel 30 is extended in the axial direction and formed with multiple steps of peripheral walls. Detection tube 40 is extended in the axial direction, and a cylindrical part extending towards ink occlusion element is formed from, and angled with respect to, the rim of flange 42. This cylindrical part including flange 42 constitutes ink occlusion element receiver 20. Other components are the same as in the above embodiment, so their description is omitted.

Also in this embodiment, the same operation and effect as in the above embodiment can be expected. Besides, since fall stopper ring 64 is engaged with the inner surface of small-diametric tapered portion of front barrel 30, it is obviously possible with a simple structure to efficiently prevent pen core 60 from falling out from detection tube 40. Further, since the cylindrical part including flange 42 serves as a holder for the ink occlusion element, it is possible to replace the used ink occlusion element 10 without soiling hands.

Next, FIGS. 6 to 11 show the fourth embodiment of the present invention. In this case, ink occlusion element receiver 20 is formed in an essentially cylindrical shape. This ink occlusion element receiver 20 is fitted into rear barrel 1 so as to receive the end portion of ink occlusion element 10. Anti-dew-condensation holes 21 are formed in the peripheral wall of ink occlusion element receiver 20 while fine indentations and projections 22 which produce capillarity are formed on the peripheral wall of ink occlusion element receiver 20.

Figure 6:
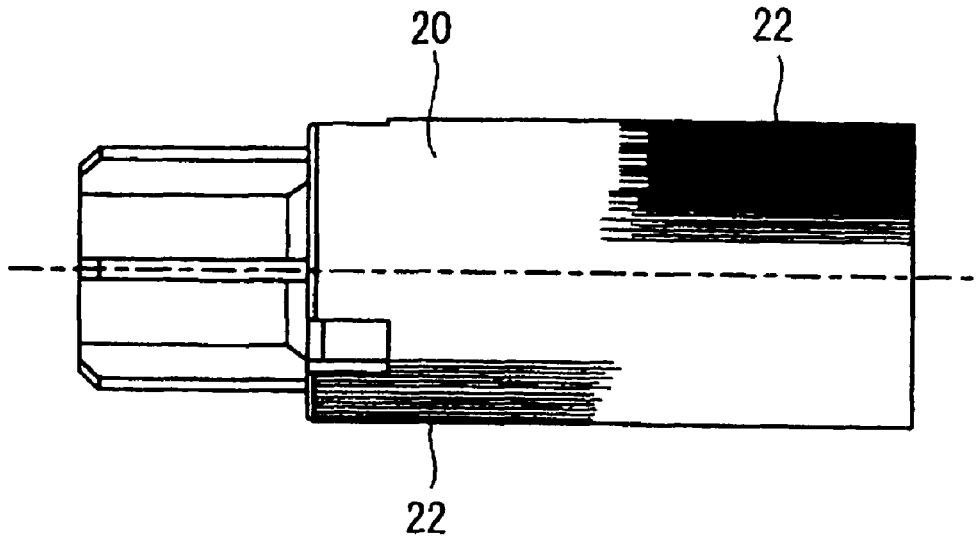
FIG. 6 is a partially sectional illustrative view showing the fourth embodiment of an applicator according to the present invention.
Figure 7:
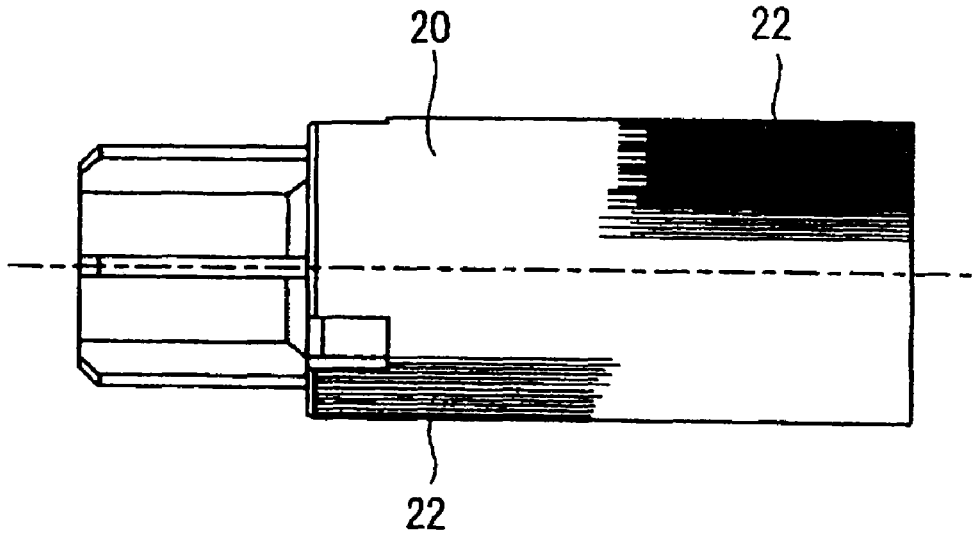
FIG. 7 is a sectional illustrative view showing an ink occlusion element receiver in the fourth embodiment of an applicator according to the present invention.
Figure 8:
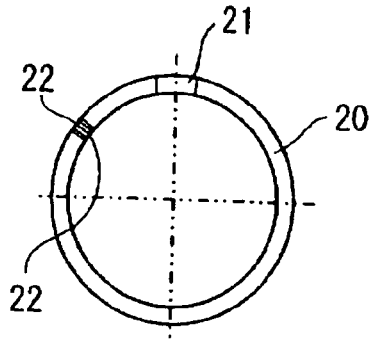
FIG. 8 is a rear side view of FIG. 7.
Figure 9:
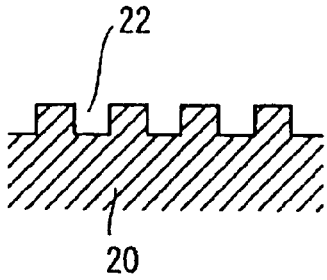
FIG. 9 is a sectional illustrative view showing indentations and projections of an ink occlusion element receiver having an indented section in the fourth embodiment of an applicator of the present invention.
Figure 10:
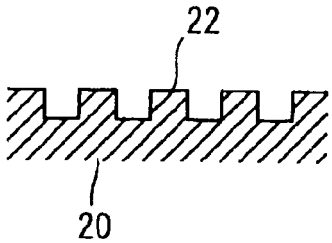
FIG. 10 is a sectional illustrative view showing indentations and projections of an ink occlusion element receiver having a projected section in the fourth embodiment of an applicator of the present invention.
Figure 11:
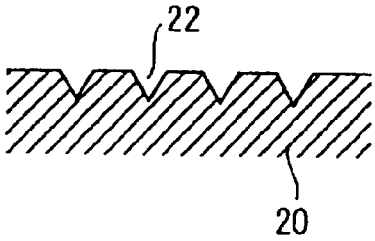
FIG. 11 is a sectional illustrative view showing indentations and projections of an ink occlusion element receiver having an essentially V-shaped section in the fourth embodiment of an applicator of the present invention.

As shown in FIGS. 6 to 8, ink occlusion element receiver 20 is formed in a hollow stepped cylindrical shape using a predetermined synthetic resin such as, for example PP or the like and provides the function of suppressing ink scattering. Formed on the peripheral wall of this ink occlusion element receiver 20 are an arbitrary number of anti-dew-condensation holes 21 for reducing the rate of evaporation from pen core 60 while fine indentations and projections 22 for producing capillary force are formed along the axial direction on the interior and exterior surfaces of the peripheral wall.

Indentations and projections 22 may be formed as, for example a plurality of grooves having a square section (see FIG. 9), projections having a square section (see FIG. 10), or grooves having a V-shaped section (see FIG. 11), arranged with a predetermined pitch in the circumferential direction of ink occlusion element receiver 20. The thus constructed ink occlusion element receiver 20 is inserted into rear barrel 1 from the opening thereof so that the receiver opposes the inner peripheral surface 2 of the large-diametric part of rear barrel 1 and comes into contact with inclined step face 4 and fits in contact with the front side end of ink occlusion element 10. Other components are the same as in the above embodiment, so their description is omitted.

Also in this embodiment, the same operation and effect as in the above embodiment can be expected. Besides, since anti-dew-condensation holes 21 lead condensation water from the external surface of ink occlusion element receiver 20 into the interior of ink occlusion element receiver 20, to thereby suppress the formation of dew condensation. Accordingly, even if alcohol-based ink is used, the formation of dew hardly occurs, hence it is possible to efficiently prevent writing failures due to dew condensation.

Further, since multiple indentations and projections 22 cause condensation dew, by capillary attraction, to seep from the external surface of ink occlusion element receiver 20 to the interior of ink occlusion element receiver 20 and return into ink occlusion element 10 or pen core 60, there is no fear of the ventilation passage of air during drawing being blocked and no thinning of drawn lines will occur due to dew condensation. With this effect it is no longer necessary to suppress the variation in the temperature inside cap 32 by making its resin wall thick, hence it is possible to cut down the cost. Further, since the external surface of ink occlusion element 10 will never become sticky, it is possible to reduce uncomfortable sensation upon its replacement.

Figure 12:
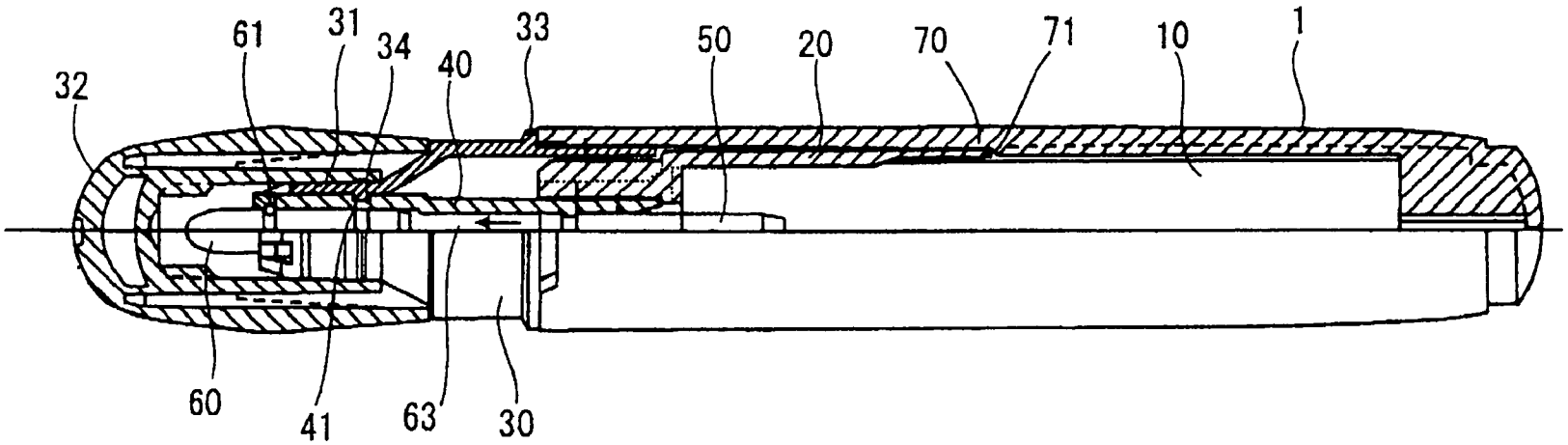
FIG. 12 is a partially sectional illustrative view showing the fifth embodiment of an applicator according to the present invention.
Figure 13:
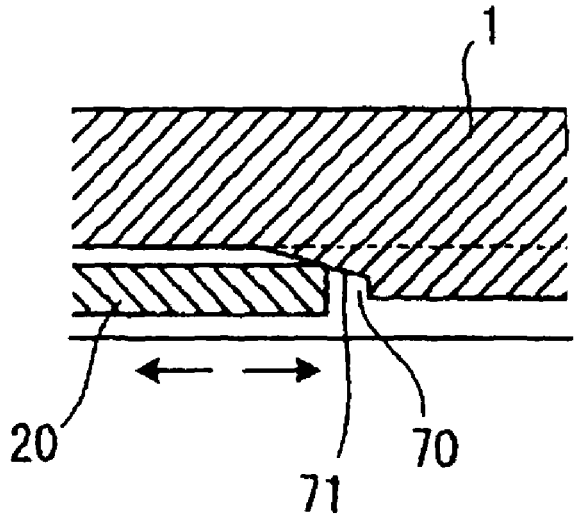
FIG. 13 is a sectional illustrative view showing a state where an ink occlusion element receiver of the fifth embodiment of an applicator of the present invention comes into contact with an inclined step face of a rear barrel.

Next, FIGS. 12 and 13 show the fifth embodiment of the present invention. This embodiment, in addition to rear barrel 1, ink occlusion element 10, ink occlusion element receiver 20, front barrel 30, detection tube 40 and joint core 50 and pen core 60, includes an impact absorbing means 70 for absorbing impacts acting on detection tube 40.

As shown in FIG. 13 impact absorbing means 70 is made up of a tapered inclined step face 71 that is formed as being inclined between large-diametric inner peripheral surface 2 and small-diametric inner peripheral surface 3 of rear barrel 1 and comes in slidable contact with the rim of the opening of ink occlusion element receiver 20. Other components are the same as in the above embodiment, so their description is omitted.

Also in this embodiment, the same operation and effect as in the above embodiment can be expected. Besides, since the rim of the opening of ink occlusion element receiver 20 is guided by the inclined step face 71 of impact absorbing means 70 and slid in the axial direction (see the arrows) when the writing instrument is dropped etc., it is possible to alleviate impacts so as to suppress or prevent serious entrance of air bubbles into detection tube 40.

Detailing this point, if an impact acted on detection tube 40 and air bubbles enter, air bubbles gradually grow up without regarding the remaining amount of ink and soon stop the passage of ink into detection space 63 of detection tube 40, thus falsely indicating an ink end state. Particularly, when the writing instrument is dropped with its pen core 60 up, ink in ink occlusion element 10 flows and the air pressure in detection tube 40 sharply decreases. Resultantly, air bubbles are formed in detection tube 40 with a high possibility.

Further, since inclined step face 71 does not just abut ink occlusion element receiver 20 to position and fix it but allows ink occlusion element receiver 20 to slide thereon with an action of an external force, it is possible to expect efficient damping effect on impacts. Accordingly, it is possible to suppress or prevent entrance of air bubbles and markedly efficiently avoid false indication of an ink end state.

Figure 14:
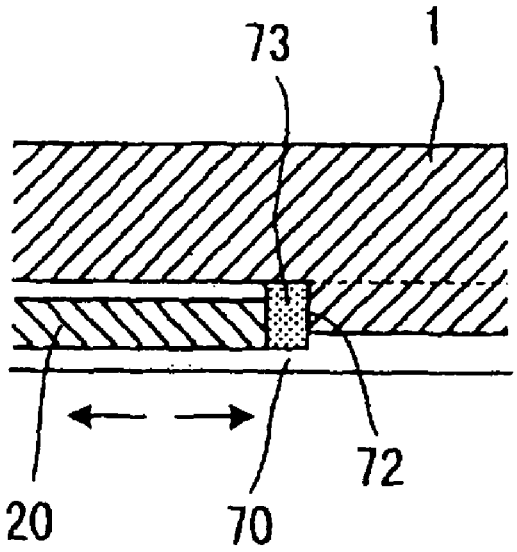
FIG. 14 is a partially sectional illustrative view showing the sixth embodiment of an applicator according to the present invention.

Next, FIG. 14 shows the sixth embodiment of the present invention. In this case, impact absorbing means 70 is comprised of a flat step face 72 formed as a section between large-diametric inner peripheral surface 2 and small-diametric inner peripheral surface 3 of rear barrel 1 and an elastic cushioning element 73 disposed between this step face 72 and the rim of the opening of ink occlusion element receiver 20.

As cushioning element 73, a single or multiple number of O-rings, endless rubber, elastomer, sponge, etc., can be considered. Other components are the same as in the above embodiment, so their description is omitted.

Also in this embodiment, the same operation and effect as in the above embodiment can be expected, and it is particularly useful if the above fifth embodiment cannot be adopted.

Next, the seventh embodiment of the present invention will be described without reference to drawings. In this case, rear barrel 1 is partially formed of elastomeric material providing flexibility and elasticity, so as to let the rear barrel 1 itself function as impact absorbing means 70.

The elastomeric material is not particularly limited but when rear barrel 1 is made of polypropylene, butyl rubber elastomers, which present excellent weather resistance and water resistance, are most preferable. Other components are the same as in the above embodiment, so their description is omitted.

Also in this embodiment, the same operation and effect as in the above embodiment can be expected, and since the rear barrel itself has the impact cushioning function of impact absorbing means 70, it is obvious that the number of parts can be reduced and the complexity of processing can be nullified.

In the above embodiment, rear barrel 1 is simply shown, but part of rear barrel 1 may be formed to be transparent if there is not any particular problem with that. It is also possible to form an integrated structure of front barrel 30, detection tube 40, joint core 50 and pen core 60. It is well enough that joint core 50 and pen core 60 are press fitted into detection tube 40, but, for example a three-jaw chuck structure, etc., may be used. Further, instead of cutting out press-fitted portion 41 as a groove extending in the circumferential direction on the outer peripheral surface of detection tube 40, the flat outer peripheral surface of detection tube 40 may be used as it as press-fitted portion 41.

Further, a cushioning element 73 such as rubber etc., may be disposed between rear barrel 1 and the end of ink occlusion element 10 so that this elastic cushioning element 73 will function as impact absorbing means 70. Moreover, impact absorbing means 70 may be provided as an elastic cushioning element 73 interposed between front barrel 30 and detection tube 40 or may be provided as an elastic cushioning element 73 interposed between detection tube 40 and joint core 50.

The invention claimed is:

1. An applicator for supplying a fluid from a fluid occlusion element to an applying part, comprising:

a hollow rear barrel accommodating the fluid occlusion element;

a fluid occlusion element receiver at least opposing the end portion of the fluid occlusion element;

a hollow-formed see-through front barrel to be attached to an opening of the rear barrel;

an essentially transparent detection tube inserted in the front barrel;

a joint core supported by the detection tube and put in contact with the fluid occlusion element; and a pen core, supported by the detection tube, spaced with a clearance from, and opposing, the joint core, and exposed from the front barrel.

2. The applicator according to claim 1, wherein the fluid is an alcohol-based ink.

3. The applicator according to claim 1, wherein the rear barrel is formed as a close-bottomed cylinder having an open front end, and part of the inner peripheral surface of the rear barrel is formed with a large-diametric inner peripheral surface and the remaining part of the inner peripheral surface of the rear barrel is formed with a small-diametric inner peripheral surface.

4. The applicator according to claim 1, wherein the fluid occlusion element receiver is formed of a hollow stepped shape, and the fluid occlusion element receiver is inserted into the opening of the rear barrel so as to fit with the front end part of fluid occlusion element.

5. The applicator according to claim 1, wherein among the front barrel, detection tube, joint core and pen core, at least the detection tube, joint core and pen core are integrated.

6. The applicator according to claim 1, wherein the front barrel is given in a transparent stepped shape and fitted into the front end part of the fluid occlusion element receiver.

7. The applicator according to claim 1, wherein the detection tube is formed in a cylindrical shape and supported by the fluid occlusion element receiver and the front barrel.

8. The applicator according to claim 1, wherein a press-fitting portion is formed on one of the inner peripheral surface of the front barrel and the outer peripheral surface of the detection tube and a press-fitted portion is formed on the other, and these press-fitting portion and press-fitted portion are at least put in strong contact with each other.

9. The applicator according to claim 1, wherein the pen core is given in an essentially cylindrical form and the maximum width portion thereof is fitted into the detection tube.

10. The applicator according to claim 1, wherein the detection tube is formed with the fluid occlusion element receiver.

11. The applicator according to claim 10, wherein a flange is projected radially outwards from the fluid occlusion element's side end of the detection tube, and the flange is adapted to constitute the fluid occlusion element receiver.

12. The applicator according to claim 1 wherein the front end part of the front barrel is formed to be a small-diametric tapered portion that gradually becomes narrower, an attachment groove is formed on the exposed surface of the pen core that is exposed from the detection tube so that a fall stopper is provided in the attachment groove, and the pen core is projected from the small-diametric tapered portion of the front barrel while the fall stopper of the pen core is put in contact with inner surface of the small-diametric tapered portion.

13. The applicator according to claim 12, wherein a flange is projected radially outwards from the fluid occlusion element's side end of the detection tube, and a cylindrical portion is extended towards the fluid occlusion element from the peripheral edge of the flange so that the flange and the cylindrical portion constitute the fluid occlusion element receiver.

14. The applicator according to claim 1, wherein the fluid occlusion element receiver is formed in an essentially cylindrical form, and the fluid occlusion element receiver is inserted into the rear barrel to fit the end of the fluid occlusion element while an anti-dew-condensation hole is formed in the peripheral wall of the fluid occlusion element receiver.

15. The applicator according to claim 14, wherein fine indentations and projections that produce capillary action is formed on the peripheral wall of the fluid occlusion element receiver, and the pattern is formed with indentations, projections and/or essentially V-shaped sections.

16. The applicator according to claim 15, wherein the impact absorbing means is given as an inclined step face formed between the large-diametric inner peripheral surface, and the small-diametric inner surface, of the rear barrel so as to be in contact with the rim of the opening of the fluid occlusion element receiver.

17. The applicator according to claim 15, wherein the impact absorbing means is comprised of a step face between the large-diametric inner peripheral surface, and the small-diametric inner surface, of the rear barrel, and a cushioning element disposed between the step face and the rim of the opening of the fluid occlusion element receiver.

18. The applicator according to claim 15, wherein the impact absorbing means is given as the rear barrel having elasticity.

19. The applicator according to claim 1, wherein an impact absorbing means that at least absorbs impacts acting on the detection tube is provided.

* * * * *